US007857078B2

(12) United States Patent
Lynde

(10) Patent No.: US 7,857,078 B2
(45) Date of Patent: Dec. 28, 2010

(54) CUTTING TOOLS AND METHODS OF MAKING THE SAME

(75) Inventor: Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 219 days.

(21) Appl. No.: 12/108,902

(22) Filed: Apr. 24, 2008

(65) Prior Publication Data

US 2009/0133937 A1 May 28, 2009

Related U.S. Application Data

(60) Provisional application No. 60/940,520, filed on May 29, 2007.

(51) Int. Cl.
*E21B 10/00* (2006.01)

(52) U.S. Cl. ..... 175/320; 175/325.5

(58) Field of Classification Search ..... 175/320, 175/325.5
See application file for complete search history.

(56) References Cited

U.S. PATENT DOCUMENTS

| | | | | |
|---|---|---|---|---|
| 1,342,424 | A | 6/1920 | Cotten | |
| 1,875,357 | A | 9/1932 | Simmons | |
| 2,300,438 | A | 11/1942 | Spang | |
| 2,804,928 | A | 9/1957 | Farrar | |
| 2,896,726 | A | 7/1959 | Bobo | |
| 3,633,671 | A | 1/1972 | Nelson | |
| 3,891,034 | A | 6/1975 | Owen et al. | |
| 3,948,322 | A | 4/1976 | Baker | |
| 5,256,315 | A | 10/1993 | Lockhart et al. | |
| 5,290,151 | A | 3/1994 | Orlando | |
| 5,338,465 | A | 8/1994 | Lockhart et al. | |
| 5,441,928 | A | 8/1995 | Albonico et al. | |
| 5,489,574 | A | 2/1996 | Miano et al. | |
| 5,490,877 | A | 2/1996 | Prevedello et al. | |
| 6,074,282 | A * | 6/2000 | Schimweg | 451/49 |
| 6,158,531 | A | 12/2000 | Vail, III | |
| 6,435,281 | B1 | 8/2002 | Baugh | |
| 6,499,539 | B1 | 12/2002 | Cobianco et al. | |
| 6,988,548 | B2 | 1/2006 | Diamond et al. | |
| 7,614,395 | B2 * | 11/2009 | Perry | 125/15 |
| 2002/0189864 | A1 | 12/2002 | Calderoni et al. | |
| 2002/0197174 | A1 | 12/2002 | Howard | |

(Continued)

FOREIGN PATENT DOCUMENTS

| | | |
|---|---|---|
| JP | 1304294 | 12/1989 |

(Continued)

OTHER PUBLICATIONS

Purl, R., et al.; "Damage to Coal Permeability During Hydraulic Fracturing"; SPE21813; Paper Presented at the Rocky Mountain Regional Meeting and Low-Permeability Reservoirs Symposium, Dever, CO; Apr. 15-17, 1991. pp. 109-115.

(Continued)

*Primary Examiner*—William P Neuder
(74) *Attorney, Agent, or Firm*—Cantor Colburn LLP

(57) ABSTRACT

A cutting tool includes a mandrel; a matrix affixed to the mandrel; and cutting material disposed within the matrix and method of making the same.

14 Claims, 4 Drawing Sheets

U.S. PATENT DOCUMENTS

| | | | |
|---|---|---|---|
| 2004/0094308 | A1 | 5/2004 | Calderoni et al. |
| 2005/0092485 | A1 | 5/2005 | Brezinski et al. |
| 2005/0224123 | A1 | 10/2005 | Baynham et al. |
| 2006/0196663 | A1 | 9/2006 | Keller |

FOREIGN PATENT DOCUMENTS

| | | |
|---|---|---|
| JP | 2183094 | 7/1990 |

OTHER PUBLICATIONS

Santos, Helio, et al.; "No-Damage Drilling: How to Achieve This Challenging Goal?"; SPE77189; IADC/SPE Asia Pacific Drilling Technology, Jakarta, Indonesia; Sep. 9-11, 2002; 10 Pgs.

Santos, Helio; "Increasing Leakoff Pressure With New Class of Drilling Fluid"; SPE78243; SPE/ISRM Rock Mechanics Conference, Irving, Texas; Oct. 20-23, 2002; 7 Pgs.

Labenski, Franck, et al.; "Drilling Fluids Approaches for Control of Wellbore Instability in Fractured Formations"; SPE85304; SPE/IADC Middle East Drilling Technology Conference and Exhibition, Abu Dhabi, UAE; Oct. 20-22, 2003. 8 Pgs.

* cited by examiner

CUTTING TOOLS AND METHODS OF MAKING THE SAME

CROSS REFERENCE TO RELATED APPLICATIONS

This application claims the benefit of an earlier filing date from U.S. Provisional Application Ser. No. 60/940,520, filed May 29, 2007, the entire disclosure of which is incorporated herein by reference.

BACKGROUND

Subsurface operations in many industries require the use of cutting tools to drill or mill (or similar) through earthen formations or in some cases through man-made additions to those formations such as concrete. Such cutting tools and their manufacture are generally machining intensive thereby making them relatively expensive to produce. Machining is required because upsets are usually desirable with respect to such cutting tools to allow cuttings to move out of the immediate location of abrasive or cutting action, usually under the influence of a cutting fluid. In order to create such upsets, a generally accepted and ubiquitously used method is to start with a larger blank material and machine away excess material. Such excess material becomes scrap and is therefore a material cost over and above the cost of machining the material in the first place.

In order to complete the manufacture of the cutting tools it is common practice to bond a high strength metal alloy material to the surface of a machined base material. This process requires a substantial amount of heat that regularly produces small cracks in the base material during the process. Cracks are problematic, as they often need to be addressed in a process that unfortunately also requires a substantial amount of heat. And further, while every effort is made to identify and address cracks in specific tools, some inevitably get through the screening process leading to breakage when put to use.

In view of the foregoing, the art will well receive improved technology with respect to cutting tools production and durability.

SUMMARY

A cutting tool includes a mandrel; a matrix affixed to the mandrel; and cutting material disposed within the matrix.

A method of making a cutting tool includes disposing a mandrel in a form; disposing at least one watercourse insert between the form and the mandrel; placing a matrix material in the form and about the mandrel.

BRIEF DESCRIPTION OF THE DRAWINGS

Referring now to the drawings wherein like elements are numbered alike in the several Figures.

DETAILED DESCRIPTION

Figure 1:
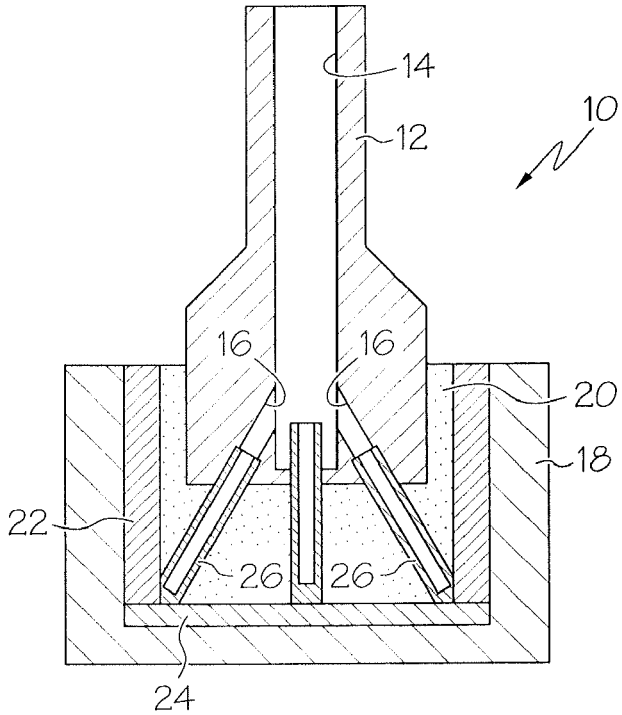
FIG. 1 is a schematic cross sectional view of a cutting tool during a manufacturing stage.

Referring to FIG. 1, a cutting tool 10 is illustrated during a process of making the same. The tool comprises a mandrel 12 having a flow passageway 14 therein, the flow passageway 14 being fluidly connected to a plurality of flow channels 16 illustrated in one of a number of possible configurations, the purpose of which is to supply cutting fluid to a target area during a cutting operation. The mandrel is illustrated disposed in a form 18 that is designed to contain a castable milling matrix 20 relative to the mandrel 12 to allow such a milling matrix 20 to be deposited at the mandrel in such a way as to bond therewith during the curing of the matrix 20. The matrix itself is a composition that does not require substantial heat to cure and in any event will not require heat sufficient to produce cracking of the base material of the mandrel 12. Stated alternatively, the matrix is a hardenable material that is applyable and hardenable at a temperate less than a temperature at which the mandrel is likely to develop heat related cracks. This can be a cold process or a relatively mild exothermic process, for example epoxy.

In one embodiment the matrix comprises a polymeric composition having an embedded cutting material, which is one or more hard particulate materials such as Tungsten carbide, Cubic Boron Nitride, Diamond, Silicone carbide and combinations including at least one of the foregoing and other similar materials mixed therein before the matrix is cured. The mixture in one embodiment will be homogenous while in other embodiments; the cutting materials mixed into the matrix may be concentrated in certain areas to affect mechanical properties (strength, wear resistance, wear pattern, etc.) of the cutting tool. One embodiment utilizes a matrix material that is proprietary to and commercially available from Protech Centerform Inc, Houston, Tex.

Again referring to FIG. 1, further illustrated are additional molding features to optimize function of the finished tool 10. These include removable watercourse inserts 22 and 24, and removable channel extension inserts 26. Together these inserts work to create a particular shape of the matrix 20 and channel extensions 28 for the conveyance of fluid applied through channels 16 through the matrix 20 and to a cutting tool-target surface interface (not specifically shown). The shapes created include watercourses 32 that provide for fluid exit route from the interface, that fluid having been provided to the interface through the mandrel 12 via channels 16 and channel extensions 28. The watercourses also provide an exit for cuttings that are entrained with the exiting fluid; the reason (along with lubrication) for the fluid in the first place. Watercourse 24 has for its purpose to provide a fluid exit for the central one or more channel extensions 28 (one shown). It is difficult to see in the end views but can be seen in FIG. 1. It will be sufficient for enablement or on of ordinary skill in the art to indicate that the watercourse (at least one, and maybe more) must intersect any central channel extensions 28 to provide for fluid conveyance.

Figure 2:
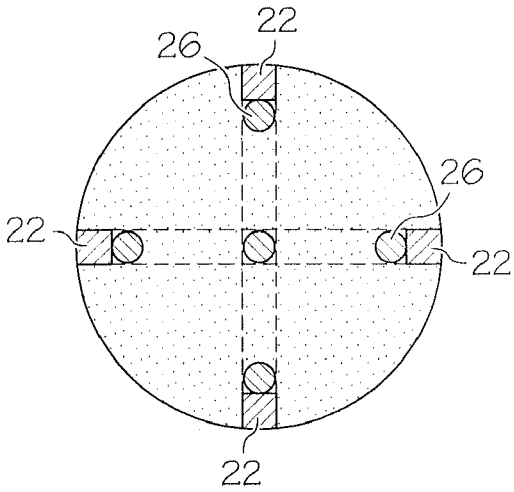
FIG. 2 is an end view of the cutting tool prior to withdrawal of all forms.
Figure 3:
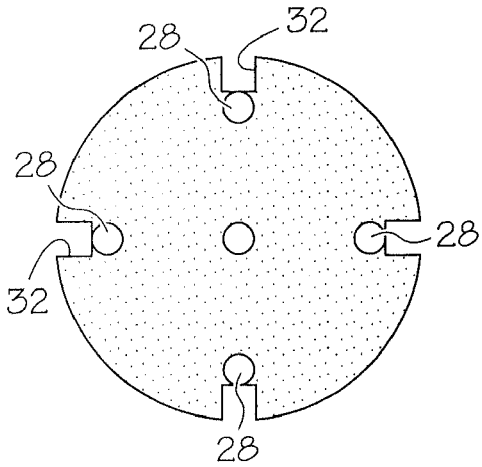
FIG. 3 is another end view of the embodiment of FIG. 1 with all forms removed, the cutting tool being ready for use.
Figure 4:
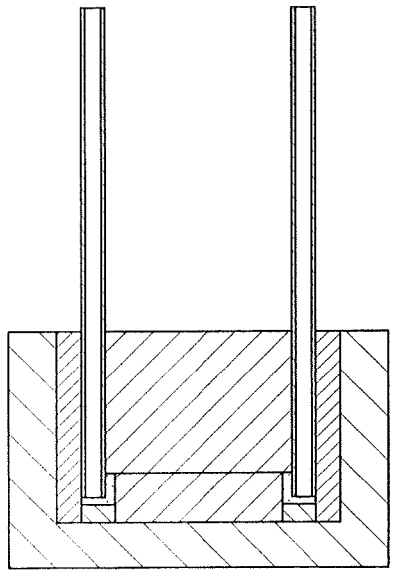
FIG. 4 is a schematic cross sectional view of another embodiment of a cutting tool during a manufacturing stage.

Referring to FIGS. 2 and 3, end views in sequential conditions are illustrated with FIG. 2 illustrating appearance after removal of the tool 10 from the form 18 but before removal of the watercourse inserts 22 and the extension inserts 26. FIG. 3 conversely is the same view with these structures removed.

Figure 5:
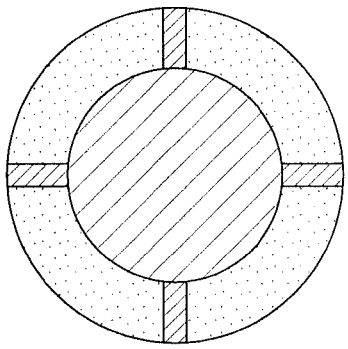
FIG. 5 is an end view of the cutting tool prior to withdrawal of all forms.
Figure 6:
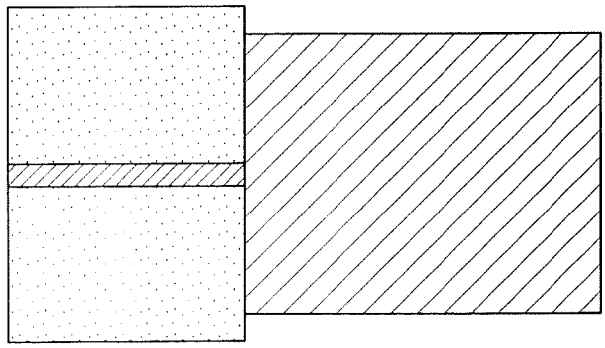
FIG. 6 is a side elevation view of the illustration of FIG. 5.
Figure 7:
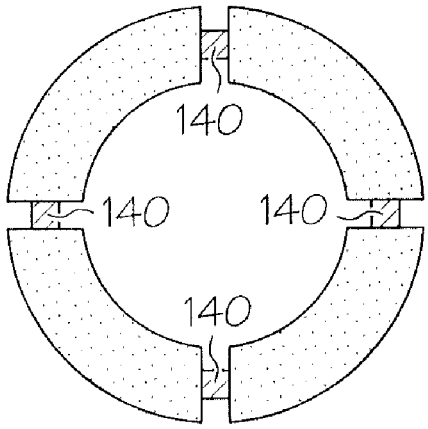
FIG. 7 is another end view of the embodiment of FIG. 4 with all forms removed, the cutting tool being ready for use.
Figure 8:
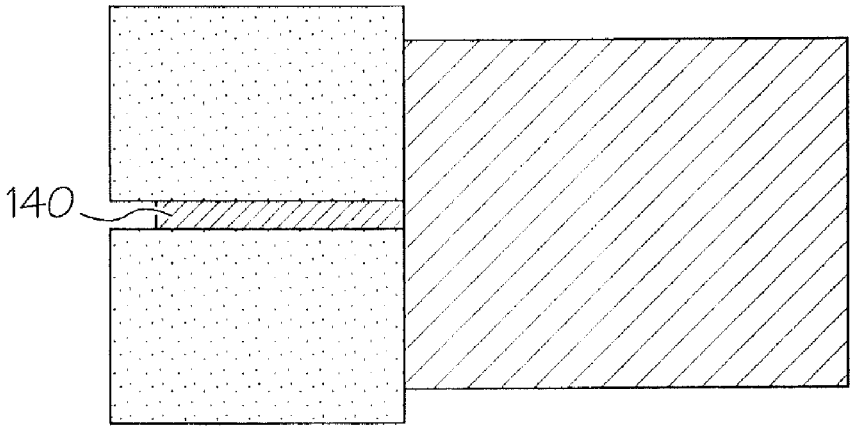
FIG. 8 is a side elevation view of the illustration of FIG. 7.

Referring now to FIGS. 4-8, an alternate embodiment cutting tool 110 is illustrated. This embodiment is directed to a hollow rotary shoe mandrel 112 configured with a matrix 120 of the same material as in the foregoing embodiment but in a different physical configuration appropriate to the hollow rotary mandrel 112. Similarly to the foregoing embodiment, the tool is constructed using a form 118 and a set of watercourse inserts 122 and 124. Channels and channel extensions are not employed in this embodiment so that channel extension inserts are not needed. The hollow rotary shoe includes, in one embodiment, four projections 140, identifiable in FIGS. 7 and 8. These projections operate to anchor the matrix 20 to the mandrel 112. It will be appreciated that watercourse inserts 122 are in this embodiment aligned with the projections 140. In other embodiments hereof they need not necessarily be aligned with the projections 140 nor is there necessarily a set of four of them. More or fewer watercourses are possible with a practical limit being related to the strength of the matrix material between adjacent watercourses. Where the matrix material becomes thin due to a large number of watercourses, the strength of the matrix in that location will naturally be reduced. In this embodiment, and due to the open nature of the mandrel 112 a plug 142 is placed into a cutting end of the mandrel 112 and configure for removal after curing or hardening of the matrix 120. FIGS. 5 and 6 provide an understanding of stages of preparation of the cutting tool 110, with FIG. 7 illustrating the tool 110 in condition for use.

Figure 9:
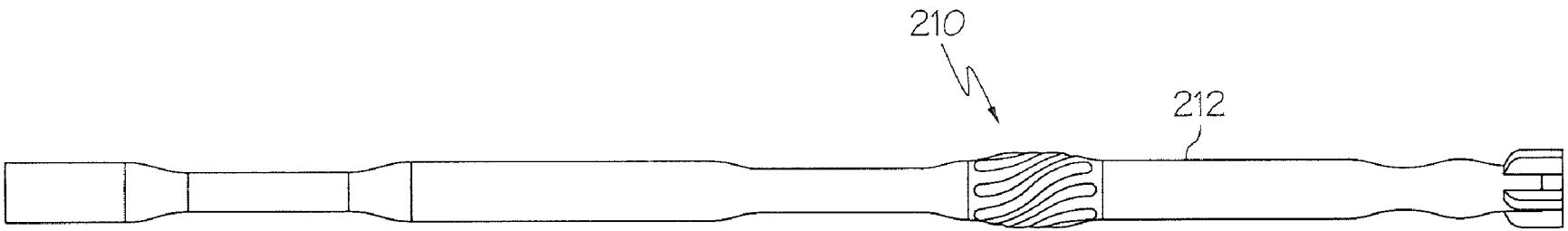
FIG. 9 is a schematic side elevation view of a reaming tool created in accordance with the teaching herein.

Referring to FIG. 9, a schematic cross sectional view of another embodiment of a cutting tool 210 is illustrated. The cutting tool 210 in this embodiment is different from the foregoing embodiments in that it occurs not at the end of a mandrel but somewhere along the length of a mandrel 212. This however is the only distinction between this embodiment and those foregoing. In all other respects they are the same, utilizing the same matrix material, hard particulate matter and appropriate inserts to provide for water courses and channel extensions where needed.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A downhole cutting tool comprising:

a mandrel;

a polymeric matrix affixed to the mandrel; and a cutting material disposed within the polymeric matrix.

2. The downhole cutting tool as claimed in claim 1 wherein the mandrel is a hollow rotary shoe mandrel.

3. The downhole cutting tool as claimed in claim 1 wherein the polymeric matrix is a hardenable material that is applyable and hardenable at a temperateure less than a temperature at which the mandrel is likely to develop heat related cracks.

4. The downhole cutting tool as claimed in claim 1 wherein the cutting material is a hard particulate material.

5. The downhole cutting tool as claimed in claim 4 wherein the hard particulate material is one or more of Tungsten carbide, Cubic Boron Nitride, Diamond, Silicone carbide and combinations including at least one of the foregoing.

6. The downhole cutting tool as claimed in claim 4 wherein the hard particulate material is homogenously dispersed in the polymeric matrix.

7. The downhole cutting tool as claimed in claim 4 wherein the hard particulate material is unhomogenously dispersed in the polymeric matrix.

8. The downhole cutting tool as claimed in claim 4 wherein the hard particulate material is one or more of Tungsten carbide, Cubic Boron Nitride, Diamond, Silicone carbide and combinations including at least one of the foregoing.

9. The downhole cutting tool as claimed in claim 4 wherein the hard particulate material is homogenously dispersed in the epoxy matrix.

10. The downhole cutting tool as claimed in claim 4 wherein the hard particulate material is unhomogenously dispersed in the epoxy matrix.

11. The downhole cutting tool as claimed in claim 1 wherein the mandrel is a hollow rotary shoe mandrel.

12. The downhole cutting tool as claimed in claim 1 wherein the epoxy matrix is a hardenable material that is applyable and hardenable at a temperature less than a temperature at which the mandrel is likely to develop heat related cracks.

13. The downhole cutting tool as claimed in claim 1 wherein the cutting material is a hard particulate material.

14. A downhole cutting tool comprising:

a mandrel;

an epoxy matrix affixed to the mandrel; and a cutting material disposed within the epoxy matrix.

* * * * *